US008173228B2

(12) United States Patent
Choi et al.

(10) Patent No.: US 8,173,228 B2
(45) Date of Patent: May 8, 2012

(54) PARTICLE REDUCTION ON SURFACES OF CHEMICAL VAPOR DEPOSITION PROCESSING APPARATUS

(75) Inventors: Soo Young Choi, Fremont, CA (US); John M. White, Hayward, CA (US); Beom Soo Park, San Jose, CA (US); Dong Kil Yim, Sungnam (KR)

(73) Assignee: Applied Materials, Inc., Santa Clara, CA (US)

( * ) Notice: Subject to any disclaimer, the term of this patent is extended or adjusted under 35 U.S.C. 154(b) by 1031 days.

(21) Appl. No.: 11/498,606

(22) Filed: Aug. 2, 2006

(65) Prior Publication Data

US 2007/0178810 A1 Aug. 2, 2007

Related U.S. Application Data

(60) Provisional application No. 60/763,105, filed on Jan. 27, 2006.

(51) Int. Cl.
*H05H 1/24* (2006.01)
*B05D 3/00* (2006.01)
*B05C 13/00* (2006.01)

(52) U.S. Cl. ..... 427/569; 427/140; 427/142

(58) Field of Classification Search ..... 427/569
See application file for complete search history.

(56) References Cited

U.S. PATENT DOCUMENTS 3,019,522 A * 2/1962 Bluth et al. ..... 72/53
4,801,785 A 1/1989 Chan et al.
4,974,369 A 12/1990 Dixon
5,104,514 A 4/1992 Quartarone
5,196,001 A 3/1993 Kao
5,200,157 A 4/1993 Toya et al.
5,288,515 A * 2/1994 Nakamura et al. ..... 427/58
5,384,682 A 1/1995 Watanabe et al.
5,565,058 A 10/1996 Banholzer et al. ..... 156/345
5,581,874 A 12/1996 Aoki et al.
5,675,471 A 10/1997 Kotecki
5,844,205 A 12/1998 White et al.
5,916,454 A 6/1999 Richardson et al. ..... 216/67

(Continued)

FOREIGN PATENT DOCUMENTS

EP 0803900 10/1997

(Continued)

OTHER PUBLICATIONS

"Abrasive Grit Sizes" by Russ Rowlett, Obtained from http://www.unc.edu/-rowlett/units/scales/grit.html on Apr. 30, 2005.

(Continued)

*Primary Examiner* — Timothy Meeks
*Assistant Examiner* — Mandy Louie
(74) *Attorney, Agent, or Firm* — Patterson & Sheridan, LLP

(57) ABSTRACT

A method of reducing the amount of particulates generated from the surface of a processing component used during plasma enhanced chemical vapor deposition of thin films. The body of the processing component comprises an aluminum alloy, and an exterior surface of said processing component is texturized to increase the amount of surface area present on the exterior surface. The texturizing process includes at least one step in which the surface to be texturized is bead blasted or chemically grained, so that the surface roughness of the texturized surface ranges from about 50 μ-inch Ra to about 1,000 μ-inch Ra.

18 Claims, 7 Drawing Sheets

U.S. PATENT DOCUMENTS

| | | | | |
|---|---|---|---|---|
| 6,007,673 | A | 12/1999 | Kugo et al. | 156/345 |
| 6,024,044 | A | 2/2000 | Law et al. | |
| 6,055,927 | A | 5/2000 | Shang et al. | |
| 6,063,203 | A | 5/2000 | Satoh | 118/728 |
| 6,064,031 | A | 5/2000 | Talwar | |
| 6,117,772 | A | 9/2000 | Murzin et al. | |
| 6,159,301 | A | 12/2000 | Sato et al. | |
| 6,159,618 | A | 12/2000 | Danroc et al. | |
| 6,182,603 | B1 * | 2/2001 | Shang et al. | 118/723 ME |
| 6,343,784 | B1 | 2/2002 | Jourde et al. | |
| 6,355,554 | B1 | 3/2002 | Choi et al. | |
| 6,368,880 | B2 | 4/2002 | Singhvi et al. | |
| 6,423,175 | B1 | 7/2002 | Huang et al. | |
| 6,458,683 | B1 | 10/2002 | Lee | |
| 6,458,684 | B1 | 10/2002 | Guo et al. | |
| 6,471,879 | B2 | 10/2002 | Hanson et al. | |
| 6,510,888 | B1 | 1/2003 | Matsumura et al. | |
| 6,537,905 | B1 | 3/2003 | Chen et al. | |
| 6,554,907 | B2 | 4/2003 | Beer et al. | |
| 6,565,984 | B1 | 5/2003 | Wu et al. | |
| 6,592,707 | B2 | 7/2003 | Shih et al. | |
| 6,649,031 | B1 | 11/2003 | Iqbal et al. | |
| 6,649,039 | B2 | 11/2003 | Hsu et al. | |
| 6,659,331 | B2 | 12/2003 | Thach et al. | |
| 6,672,917 | B2 | 1/2004 | Matsuda et al. | |
| 6,713,188 | B2 | 3/2004 | Wu et al. | |
| 6,775,873 | B2 | 8/2004 | Luoma | |
| 6,776,873 | B1 | 8/2004 | Sun et al. | |
| 6,841,049 | B2 | 1/2005 | Ito et al. | |
| 2001/0035127 | A1 * | 11/2001 | Metzner et al. | 118/715 |
| 2002/0012022 | A1 | 1/2002 | Fassler et al. | |
| 2002/0063108 | A1 | 5/2002 | Wang et al. | |
| 2002/0148941 | A1 | 10/2002 | Sorokov et al. | |
| 2002/0176219 | A1 | 11/2002 | Sakaue et al. | |
| 2003/0010446 | A1 | 1/2003 | Kajiyama et al. | |
| 2003/0047464 | A1 | 3/2003 | Sun et al. | |
| 2003/0150530 | A1 | 8/2003 | Lin et al. | |
| 2003/0205479 | A1 | 11/2003 | Lin et al. | |
| 2004/0129574 | A1 | 7/2004 | Kia et al. | |
| 2004/0221959 | A1 | 11/2004 | Choi et al. | |
| 2005/0037193 | A1 | 2/2005 | Sun et al. | |
| 2006/0032586 | A1 | 2/2006 | Choi et al. | |
| 2006/0159940 | A1 | 7/2006 | Bhatnagar et al. | |
| 2006/0185795 | A1 | 8/2006 | Choi et al. | |

FOREIGN PATENT DOCUMENTS

| | | | |
|---|---|---|---|
| EP | 1193751 | | 4/2002 |
| JP | 03146672 | | 6/1991 |
| JP | 0408332 | | 1/1992 |
| JP | 05163597 | | 6/1993 |
| JP | 07326655 | | 12/1995 |
| JP | 09323234 | | 12/1997 |
| JP | 10340896 | | 12/1998 |
| JP | 2001117079 | | 4/2001 |
| JP | 2001298013 | A | 10/2001 |
| JP | 2002252276 | | 9/2002 |
| JP | 2004211128 | * | 7/2004 |
| KR | 2001105389 | | 11/2001 |
| KR | 200312050 | | 2/2003 |
| KR | 200332489 | | 4/2003 |
| RU | 1797027 | A1 | 2/1993 |
| TW | 541639 | | 7/2003 |
| WO | WO-0060658 | | 10/2000 |
| WO | WO-0171784 | | 9/2001 |

OTHER PUBLICATIONS

Chinese Third Office Action dated Apr. 27, 2007 for Chinese Application No. 200410034739.0.

Definition of "Corundum (emery)", Obtained from Hawley's Condensed Chemical Dictionary, 14th ed. at http://www.knovel.com on Apr. 30, 2005.

European Office Action dated Feb. 15, 2007 for European Application No. 04011066.0-2119.

European Office Action dated Jul. 25, 2008 for European Application No. 04011066.0-2119.

European Office Action dated Nov. 21, 2007 for European Application No. 04011066.0-2119.

European Search Report dated Aug. 27, 2004 for European Application No. 04011066.0-2119.

European Search Report for EP 04011066, dated Sep. 3, 2004.

First Office Action for Application No. 200410034739.0; Issued Aug. 11, 2006; People's Republic of China.

Japanese Notice of Reasons for Rejection dated Jun. 17, 2008 for Japanese Application No. 2004-140365.

Japanese Office Action, Patent Application No. 2004-140365, dated Feb. 24, 2009.

Korean Office Action dated Dec. 27, 2005 for Korean Application No. 200432489.

Korean Office Action dated Jul. 23, 2007 for Korean Application No. 20060070677.

Korean Office Action dated Nov. 10, 2006 for Korean Application No. 20060070677.

Lowenheim, Frederick, Modern Electroplating, Chapter 30, "Anodizing", pp. 632-641.

Search Report dated Aug. 11, 2009 for Taiwan Patent Application No. 95122556.

Second Office Action for Application No. 200410034739.0; Issued Jan. 12, 2007; People's Republic of China.

Summary of Office Action dated Aug. 17, 2009 for Taiwan Patent Application No. 95122556.

Taiwan Office Action dated Apr. 9, 2008 for Taiwan Application No. 093112801 with Taiwanese Search Report.

Taiwan Office Action dated Jul. 21, 2008 for Taiwan Application No. 95122556 with Taiwanese Search Report.

Taiwan Office Action dated Nov. 28, 2008 for Taiwan Application No. 093112801.

* cited by examiner

302

300

20μm

304

402

400

50μm

404

PARTICLE REDUCTION ON SURFACES OF CHEMICAL VAPOR DEPOSITION PROCESSING APPARATUS

RELATED APPLICATIONS

This application is related to the following U.S. Patent Applications: U.S. application Ser. No. 11/021,416, filed Dec. 22, 2004, which is currently pending; U.S. application Ser. No. 10/962,936, filed Oct. 12, 2004, which is currently pending; U.S. application Ser. No. 10/897,775, filed Jul. 23, 2004, which is currently pending; U.S. application Ser. No. 10/889,683, filed Jul. 12, 2004, which is currently pending; U.S. application Ser. No. 10/829,016, filed Apr. 20, 2004, which is currently pending; and, U.S. Provisional Application Ser. No. 60/570,876, filed May 12, 2004. Each of the aforementioned applications are hereby incorporated by reference in their entireties. Priority is claimed under U.S. Provisional Application Ser. No. 60/763,105, filed Jan. 27, 2006.

BACKGROUND OF THE INVENTION

1. Field of the Invention

The invention generally relates to a method of controlling particulates generated on the surface of a gas diffuser used during plasma enhanced chemical vapor deposition (PECVD) of a thin film of the kind generally known in the semiconductor industry.

2. Brief Description of the Background Art

The presence of information in this section is not an admission that such information is prior art with respect to the invention described and claimed herein.

Current interest in thin film transistor (TFT) arrays is particularly high because these devices are used in liquid crystal active matrix displays (LCDs) of the kind often employed for computer and television flat panels. The liquid crystal active matrix displays may also contain light-emitting diodes (LEDs) for back lighting. As an alternative to LCD displays, organic light-emitting diodes (OLEDs) have also been used for active matrix displays, and these organic light-emitting diodes require TFTs for addressing the activity of the displays. Solar cells are also of particular interest at this time, due to the high cost of traditional energy sources. The technology used to produce solar cells is very similar to that used to create flat panel displays. Photo diodes in general are produced using the technology which is used to create flat panel displays and solar cells.

By way of example, the thin films which make up a TFT are generally produced using plasma enhanced chemical vapor deposition (PECVD). PECVD employs the introduction of a precursor gas or gas mixture into a vacuum chamber that contains a substrate. The precursor gas or gas mixture is typically directed downwardly through a distribution plate situated adjacent to a substrate on which a film is to be deposited. The precursor gas or gas mixture in the chamber is energized (e.g., excited) into a plasma by applying energy to the gas mixture. The plasma comes into contact with various surfaces within the processing chamber in which the PECVD is carried out, such as: The plasma source gas distribution plate; the susceptor on which a substrate typically rests; the shadow frame used to control build up of deposited film near the edge of the substrate; the chamber liner present adjacent to the plasma formation area within the chamber; and, in the slit valve cavity/opening (where the slit valve is the opening through which a substrate passes when entering and leaving the processing chamber) by way of example and not by way of limitation.

One commonly used method of energy application (by way of example and not by way of limitation) is the introduction of radio frequency (RF) power into the chamber from one or more RF sources coupled to the chamber. The excited gas or gas mixture reacts in the processing chamber and at the substrate surface to form a layer of material on the substrate surface. Typically the back side of the substrate is positioned on a temperature controlled substrate support pedestal, which is typically a susceptor. Volatile by-products produced during the film-forming reaction are pumped from the chamber through an exhaust system.

By way of example, the TFT arrays created using PECVD are typically created on a flat substrate. The substrate may be a semiconductor substrate, or may be a transparent substrate, such as a glass, quartz, sapphire, or a clear plastic film. TFT arrays typically employ silicon-containing films, such as microcrystalline silicon (μc-Si), or amorphous silicon (α-silicon), polycrystalline silicon (polysilicon), n-type (n+) or p-type (p+) doped polycyrstalline silicon, silicon oxide, silicon oxynitride, or silicon nitride. The initial substrate upon which the layered film structure is deposited may vary substantially and may be selected from glass, quartz, sapphire, plastic, or a semiconductor substrate, by way of example and not by way of limitation. The films are typically deposited using a PECVD system or other conventional methods known in the art. During PECVD thin film deposition, some film formation may occur upon various surfaces within the processing chamber, such as the gas diffuser, the susceptor, the shadow frame, the slit valve cavities, and interior liners of the processing chamber.

Problem particulates have been generated during the PECVD deposition of silicon-comprising films (and other thin film layers as well). Due to the nanometer sized features of today's semiconductor devices, the presence of particulates on device surfaces substantially reduces the yield of operable devices produced on a semiconductor substrate. The particulate problem is particularly important when the device surface is of the size used in flat panel displays where the inoperability of contaminated devices in the area of the particulates produces a defect which is a readily apparent source of distraction to the user of display device. Defects on photodiode surfaces used in small device displays and indicators is also a major problem. While defects on solar cell surfaces may not be as critical, the overall performance of the solar cell may be affected if the contaminant level is sufficiently high.

The substrate for a display device employing a TFT structure typically comprises a material that is essentially optically transparent in the visible spectrum, such as glass, quartz, sapphire, or a clear plastic, as previously mentioned. The substrate may be of varying shapes or dimensions. Typically, for TFT applications, the substrate is a glass substrate with a surface area greater than about 500 $cm^2$. A surface area of greater than about 45,000 $cm^2$ is not uncommon. As the size of flat panel displays increase, it becomes increasingly difficult to control particulate generation during the thin film deposition processes.

During investigative studies related to the source of particulates generated during the PECVD film deposition process, it became apparent that a substantial number of particulates which end up on the surface of a TFT device are generated at the surface of the gas diffuser used to supply the reactive gases used to generate films on the TFT structure. FIG. 1 shows a gas diffuser 100 of the kind frequently used in the semiconductor industry during PECVD of thin films on a flat panel display substrate. The gas diffuser is commonly fabricated from an aluminum alloy. Due to the reactivity of gaseous precursors used in the PECVD process for thin film generation of doped or un-doped (intrinsic) amorphous silicon (a-Si), silicon dioxide ($SiO_2$), silicon oxynitride (SiON) and silicon nitride (SiN) films of the kind used in liquid crystal displays (or flat panels), for example and not by way of limitation, it is important to provide a surface on the gas diffuser which is as resistant as possible to chemical reactions which generate particulates. In addition, it is important that there be adequate surface area on the surface of the gas diffuser which faces the TFT substrate, so that residue films generated during the TFT film forming process can adhere to the surface of the gas diffuser rather than fall onto the surface of the TFT substrate. There have been a number of theories about not only the source of particulates, but also methods of preventing particulates from leaving the surface of the diffuser to fall upon a substrate which is processed beneath the gas diffuser.

In the past, in an attempt to protect the aluminum alloy surface from corrosion by the reactive PECVD environment, a layer of aluminum oxide, typically produced by an anodization process, was generated on the surface of the gas diffuser. However, due to the relatively sharp corner radii of the gas-supplying openings on the surface of the gas diffuser, it is very difficult to generate an anodized coating which exhibits sufficient integrity at such sharp corner radii. FIG. 1 shows a schematic of a typical gas diffuser 100 of the kind used in the fabrication of flat screen displays. The gas diffuser 100 is attached to a hoisting device 105 which is used to position gas diffuser 100 in a PECVD processing chamber. The exterior surface 102 of gas diffuser 100 is positioned so that it is facing a substrate (not shown) on which thin films are PECVD deposited. There are thousands of gas-supplying openings 104 on the exterior surface 102 of gas diffuser 100.

FIG. 2A shows a schematic of a gas opening 200 of a kind which may be used as a gas-supply opening 104 on exterior surface 102 of the gas diffuser 100 illustrated in FIG. 1. The flat surface 202 forms the exterior surface 102 of gas diffuser 100, which faces the workpiece substrate upon which a thin film is PECVD deposited. The inside corner radius 214 between flat surface 202 and the diffuser hole surface 204 is a relatively sharp radius. Relative dimensions of the diffuser hole surface 204, the diffuser hole taper 206, the pin hole 208, and the back side hole 210 of the gas opening 200 permit control over gas flow rates during PECVD thin film deposition, as described in the related applications previously referred to herein.

FIG. 2B shows a photomicrograph of a corner radius 214 of the kind shown in FIG. 2A, where the corner radius 214 is located between flat surface 202 of the gas diffuser and the hole surface 204. An anodized layer 222 has been created over the hole surface 204 for purposes of protecting exterior surface of the gas diffuser. However, the anodized layer 222 integrity at a relatively sharp corner radius 214 cannot be maintained, and eventually fails as illustrated at 224 in FIG. 2B.

Just recently we determined that not only does failure of the anodized layer 222 expose the underlying aluminum flat surface 202 to attack by reactive plasma gases, but the anodized layer 222 itself flakes off and adds to the particulate formation problem. Analysis of the composition of the anodized layers which have been in service on the gas diffuser surface for a time period shows a higher fluorine content at the upper surface of the anodized layer, where the anodized layer has pitted and is being attacked by process gases during the PECVD film deposition process. As a result, it was determined that it is advisable not to anodize the aluminum surface of the diffuser.

The non-anodized, bare, polished surface of the aluminum/aluminum alloy gas diffuser continues to be exposed to the harsh environment in the PECVD deposition chamber and is under attack by the PECVD precursor gases and byproducts of the film-forming reactions. This non-anodized, bare, polished surface of the aluminum/aluminum alloy gas diffuser needs to be protected in the best manner possible to reduce the formation of particulates which may fall upon a substrate processed beneath the gas diffuser.

DETAILED DESCRIPTION OF EXEMPLARY EMBODIMENTS

As a preface to the detailed description presented below, it should be noted that, as used in this specification and the appended claims, the singular forms "a", "an", and "the" include plural referents, unless the context clearly dictates otherwise.

When the term "about" is used herein, this indicates that the precision of the nominal value recited is within ±10%.

Investigation of the source of particulate generation from a non-anodized gas diffuser has illustrated, unexpectedly, that the surface of the aluminum/aluminum alloy itself is a major source of particulate generation. A first portion of the particulates contain aluminum, typically in combination with fluorine and come directly from the aluminum surface of the gas diffuser. A second portion of the particulates contains silicon and other components which indicate that the particulates are flakes of PECVD film residues which are falling from the gas diffuser surface. It is desired to have the gas diffuser external surface area be adequate to provide adhesion for a substantial quantity of PECVD film residues, while being shaped in a manner such that thin edges of aluminum are not exposed to chemical attack. In addition to the gas diffuser, there are similar problems with respect to other internal aluminum surfaces within the process chamber, including aluminum component surfaces present within the process chamber, when such surfaces are exposed to plasma discharge.

Polished, bare aluminum alloy tends to be somewhat irregular and ragged in shape, with thin edges of metal structure extending upward, providing an increased surface area for reaction with the PECVD film precursor gases. At the same time, the surface area available for adhering of PECVD thin film residues is relatively minor. It is desired to texture the exterior surface 202 of the of the gas diffuser which surrounds gas diffuser holes 204, and to texture other aluminum alloy surfaces within the process chamber which are exposed to a plasma discharge. The amount of texturing achieved is measured by measuring the exterior surface roughness of the gas diffuser or other aluminum surface, with a desired roughness ranging from about 50 μ-inches Ra to about 1,000 μ-inches Ra.

Figure 1:
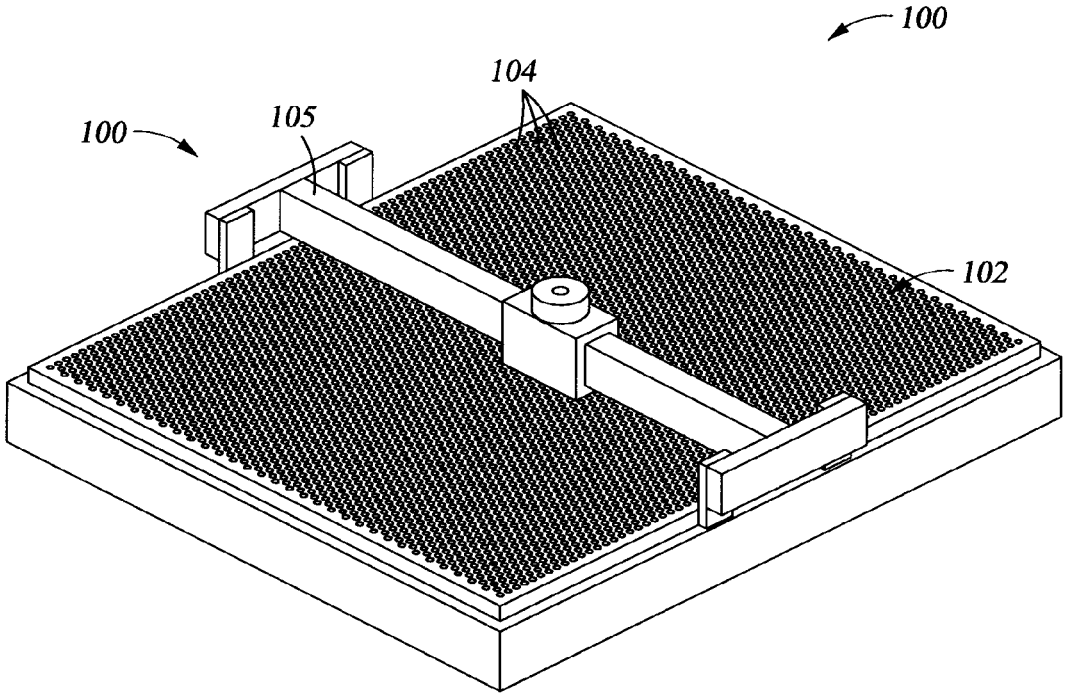
FIG. 1 shows a photograph of a gas diffuser typical of the kind used in the semiconductor industry in the fabrication of flat panel displays.
Figure 2A:
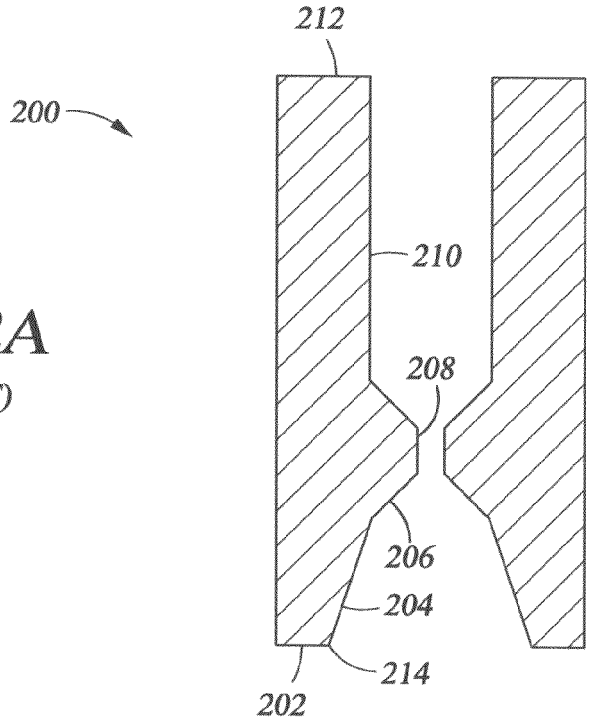
Fig. 2A (PRIOR ART)
FIG. 2A shows a schematic of one design of a gas diffuser opening which performs well in a gas diffuser of the kind shown in FIG. 1.
Figure 2B:
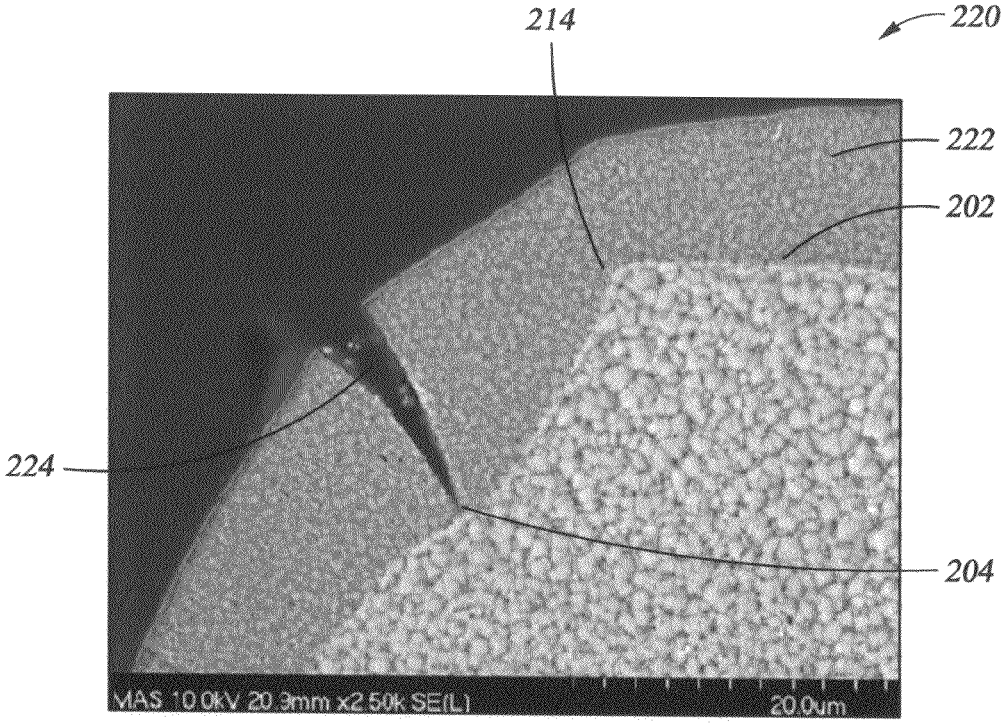
Fig. 2B (PRIOR ART)
FIG. 2B shows a photomicrograph of a failed anodized aluminum coating at a corner of one of the radii of the gas diffuser opening illustrated in FIG. 2A.

The textured aluminum surfaces of the kind described above are significantly different from the surface 204 inside of the cone-shaped openings of the diffuser holes from which the PECVD film precursor gases exit. This surface 204 is relatively smooth, typically exhibiting a surface finish of about 20 μ-inch Ra. This smoother surface inside the openings 104 shown in FIG. 1, may be produced by a process referred to as Enhanced Cleaning, in which the surface of the aluminum/aluminum alloy is anodized to a thickness of about 10 μm, followed by chemical stripping off of the anodized layer using a caustic etching solution, to produce a relatively smooth surface on the bare aluminum/aluminum alloy.

While use of the Enhanced Cleaning alone appears to be adequate for removing machining debris from inside the gas diffusion openings, it is not adequate on the outside surface of the gas diffuser which surrounds the gas diffusion openings, because the surface finish produced does not provide adequate adhering surface for the PECVD film residues described above.

To provide the increased exterior surface area on the gas diffuser, or on the surface of a chamber liner, susceptor, shadow frame or slit valve cavity, for example, a number of different combinations of processing may be used. For example, an Enhanced Clean (EC), followed by Bead Blasting (BB), followed by Light Clean (LC), all of which are subsequently defined herein, may be used. An alternative of LC, followed by BB, followed by EC may be used. Another alternative of Chemical Clean (CC), followed by BB, followed by Ultrasonic Clean (UC) may be used. Another alternative of LC, followed by BB, followed by CC may be used. In some instances two BB steps may be used, where the first step is carried out using a larger size bead, followed by a second step using a smaller size bead. One skilled in the art will envision a number of possible combinations of these surface finishing techniques.

In the above examples, the major texturing step is Bead Blasting, however it is possible to substitute a Chemical Graining step of the kind known in the art for Bead Blasting, as the major texturing step.

A gas diffuser roughness ranging between about 50 μ-inch Ra and about 1,000 μ-inch Ra has been achieved using various combinations of the techniques described above. Optionally, a chemical cleaning step may be used after the increase in gas diffuser exterior surface area, for purposes of general clean up. The Table below provides a series of examples where different techniques were used to provide a controlled surface texture/finish on the surface of an aluminum alloy coupon.

TABLE

| Sample No. | Surface Roughness μ-inch Ra | 1st Surface Treatment | 2nd Surface Treatment | 3rd Surface Treatment | Condition/ Description |
|---|---|---|---|---|---|
| 2A | 25 | none | none | none | |
| 2B | | none | none | none | |
| 3A | 25 | JB[1] | none | none | |
| 3B | | JB[1] | none | none | |
| 4A | 25 | JB[1] | EC[3] | none | current production |
| 4B | | JB[1] | EC[3] | none | current production |
| 5A | 25 | JB[1] | EC[3] | EC[3] | 2X EC |
| 5B | | JB[1] | EC[3] | EC[3] | 2X EC |
| 6A | 45 | JB[1] | BB-1 | EC[3] | BB-1 + EC |
| 6B | | JB[1] | BB-1 | EC[3] | BB-1 + EC |
| 7A | 68 | JB[1] | BB-2 | EC[3] | BB-2 + EC |
| 7B | | JB[1] | BB-2 | EC[3] | BB-2 + EC |
| 8A | 100 | JB[1] | BB-3 | EC[3] | BB-3 + EC |
| 8B | | JB[1] | BB-3 | EC[3] | BB-3 + EC |
| 9A | 70 | JB[1] | CC[2] | BB-2 | CC + BB-2 |
| 9B | | JB[1] | CC[2] | BB-2 | CC + BB-2 |
| 10A | 70 | CC[2] | BB-2 | UC[4] | CC + BB-2 + UC[5] |
| 10B | | CC[2] | BB-2 | UC[4] | CC + BB-2 + UC[5] |

[1]JB refers to "Jitter Bug" which is an industry known technique for lightly sanding of an aluminum surface to remove aluminum burrs an to polish sharp edges, but the technique does not completely remove machining debris.

[2]CC refers to a Chemical Cleaning procedure using a mixture of $HNO_3$, HF, and DI water in contact with the aluminum surface for a short time period, typically about 30 seconds. This procedure is defined in more detail subsequently herein

[3]EC refers to Enhanced Cleaning, in which the aluminum surface is treated with a mixture of $HNO_3$, NaOH, $H_3PO_4/H_2SO_4$, followed by anodization using $H_2SO_4$ to produce an anodized layer about 10 μm thick, followed by stripping of the anodization layer using a caustic etching solution. This procedure is defined in more detail subsequently herein.

[4]UC refers to Ultrasonic Cleaning of the surface in a manner generally known in the art.

BB-1 refers to Bead Blasting with material having a bead size of about 40 μ-inch.

BB-2 refers to Bead Blasting with material having a bead size of about 70 μ-inch.

BB-3 refers to Bead Blasting with a material having a bead size of about 100 μ-inch.

Figure 3:
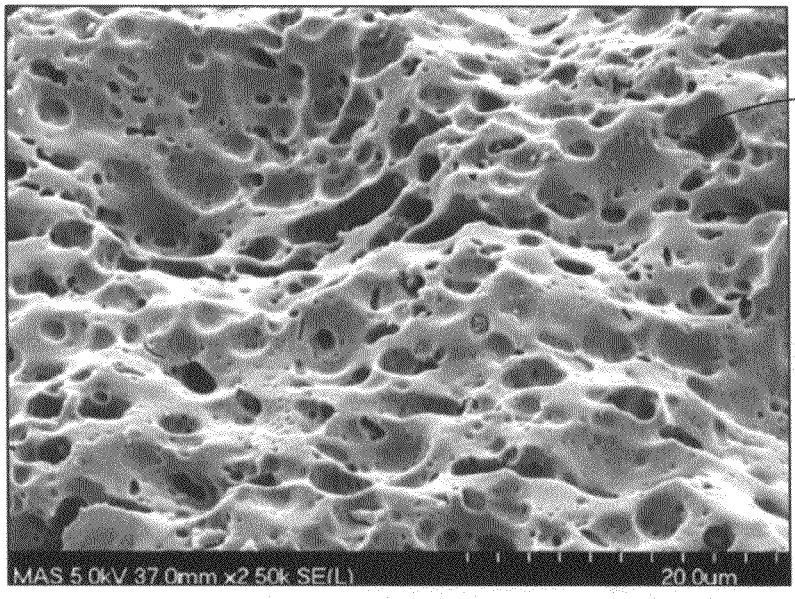
Fig. 3 (PRIOR ART)
FIG. 3 shows a photomicrograph of an anodized aluminum surface, where the magnification is 1750.

FIG. 3 shows a photomicrograph of a typical anodized aluminum layer 300 of the kind which had been used in the past to protect a gas diffuser surface. The surface 302 typically exhibited a roughness in the range of about 20 μ-inch Ra. The scale of the photomicrograph is shown as 304. While the surface was helpful in protecting an underlying aluminum alloy gas diffuser surface from chemical attack when the anodized aluminum layer was not required to cover a sharp radius, the amount of surface area provided was not adequate for adhering of PECVD film residues.

Figure 4:
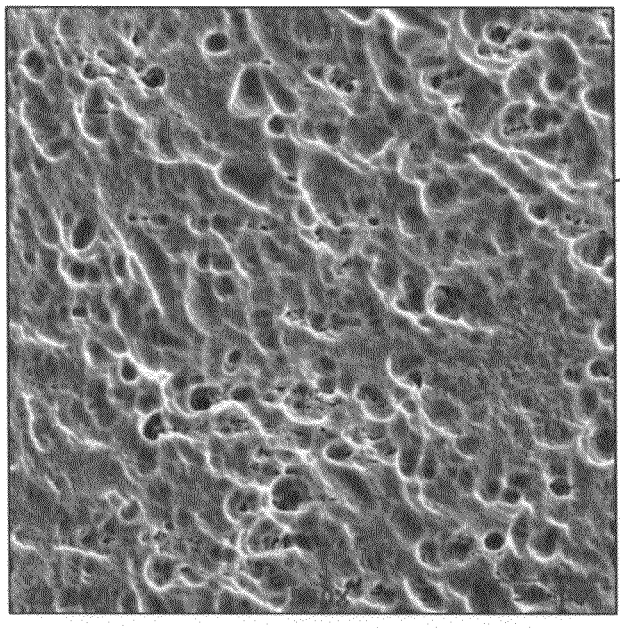
Fig. 4 (PRIOR ART)
FIG. 4 shows a photomicrograph of an aluminum alloy surface which has been Bead Blasted with a medium which produces a surface roughness of about 40 μ-inch Ra. The magnification is 875.

FIG. 4 shows a photomicrograph 400 of an aluminum alloy surface 402 which has been Bead Blasted with a medium which produces a surface roughness of about 40 μ-inch Ra. The scale for the photomicrograph is shown as 404. The magnification is 875. Bead blasting may be used to provide increased surface area, but when followed with an EC step, anodization residue may be formed which is due to insufficient local stripping. For this reason, when Bead Blasting is used to increase surface area, rather than chemical graining, it is advisable to follow the Bead Blasting with a chemical cleaning step which is CC or LC, rather than EC.

Figure 5A:
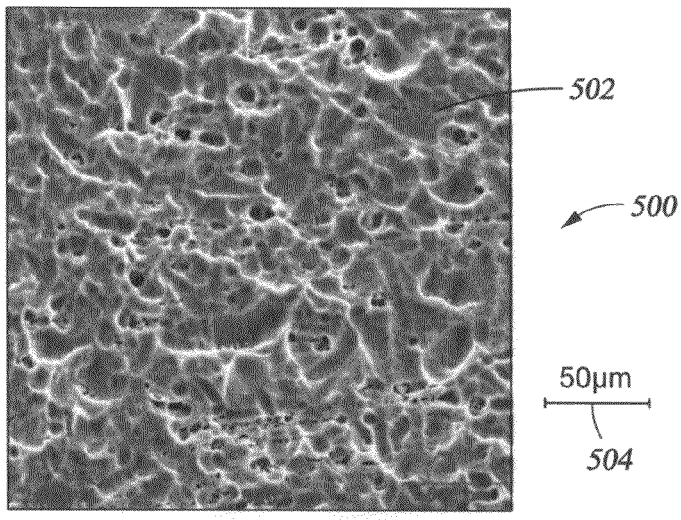
FIG. 5 A shows a photomicrograph of a Bead Blasted surface followed by Enhanced Cleaning. The magnification is 875.
FIG. 5B shows a photomicrograph of a Chemically Cleaned surface which was subsequently Bead Blasted. The magnification is 875.
FIG. 5C shows a photomicrograph of a Chemically Cleaned surface which was subsequently Bead Blasted and then Ultrasonically Cleaned. The magnification is 875.
Figure 5B:
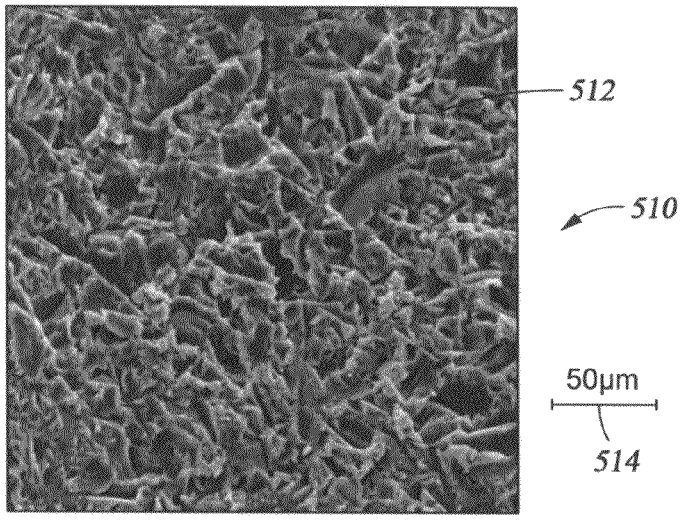
Figure 5C:
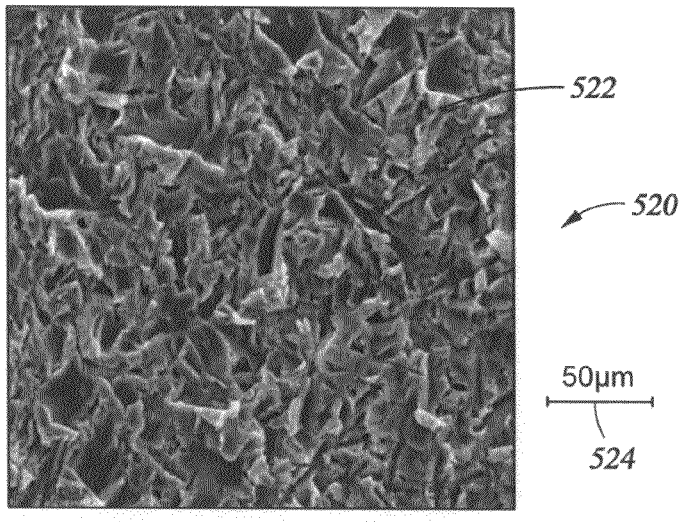

FIG. 5A shows a photomicrograph 500 of a surface 502 which was Bead Blasted followed by Enhanced Cleaning. The scale of the photomicrograph is shown as 504. The magnification is 875. FIG. 5B shows a photomicrograph 510 of a surface 512 which was Chemically Cleaned, followed by Bead Blasting. The scale of the photomicrograph is shown as 514. The magnification is 875. FIG. 5C shows a photomicrograph 520 of a surface 522 which was Chemically Cleaned, followed by Bead Blasting, followed by Ultrasonic Cleaning. The scale of the photomicrograph is shown as 524. The magnification is 875.

Figure 6A:
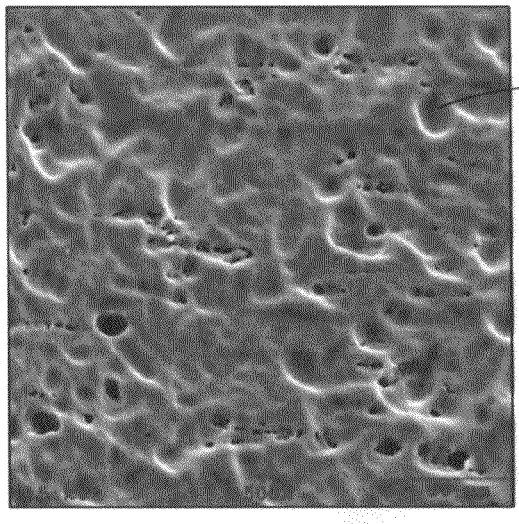
FIG. 6A shows a photomicrograph of the Bead Blasted and Enhanced Cleaned surface of FIG. 5A after a RPSC Burn In. The magnification is 875.
Figure 6B:
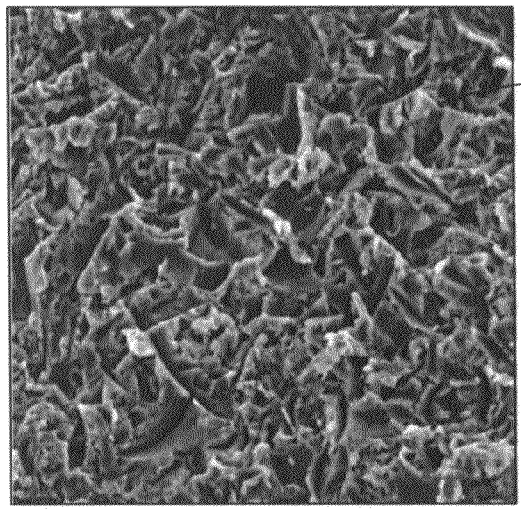
FIG. 6B shows a photomicrograph of the Chemically Cleaned and Bead Blasted surface of FIG. 5B after a RPSC Burn In. The magnification is 875.
Figure 6C:
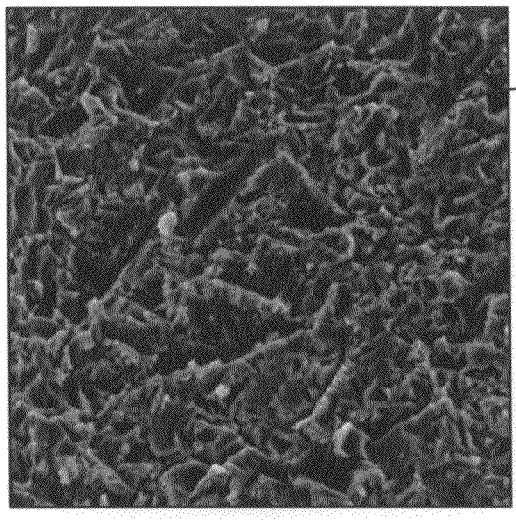
FIG. 6C shows a photomicrograph of the Chemically Cleaned, Bead Blasted, and Ultrasonically Cleaned surface of FIG. 5C after a RPSC Burn In. The magnification is 875.

FIG. 6A shows a photomicrograph 600 of the surface 602 of Bead Blasted and Enhanced Cleaned surface 502 of FIG. 5A after an RPSC Burn In. The scale of the photomicrograph is shown as 604. The magnification is 875. FIG. 6B shows a photomicrograph 610 of the Chemically Cleaned and Bead Blasted surface 510 of FIG. 5B after an RPSC Burn In. The scale of the photomicrograph is shown as 614. The magnification is 875. FIG. 6C shows a photomicrograph of the surface 622 of Chemically Cleaned, Bead Blasted, and Ultrasonically Cleaned surface 522 of FIG. 5C after an RPSC Burn In. The scale of the photomicrograph is shown as 624. The magnification is 875. The RPSC Burn, which is described subsequently herein, is basically the exposure of the coupon surface to the harshest conditions which are likely to be encountered during PECVD thin film deposition processing. This exposure provides an indication of the maximum change in the surface of the gas diffuser which may occur during processing. As can be seen by comparing FIGS. 5A with 6A, 5B with 6B, and 5C with 6C, while the RPSC Burn tends to substantially smooth the coupon surface where the aluminum alloy was Bead Blasted and Enhanced Cleaned, it had little effect on the Chemically Cleaned and Bead Blasted coupon surface or the Chemically Cleaned, Bead Blasted, and Ultrasonically Cleaned surface.

Methods and Definitions

Chemical Preparation for Lite Chem Etch ("LC")

1. Soak clean in natural soap cleaner for 30-35 minutes at 130-140° F.
2. Rinse in room temperature deionized water for 30-60 seconds with spray and vibration.
3. Immerse in room temperature fluoride-containing acid etch with vibration for 25 to 35 seconds per slide.
4. Rinse in room temperature deionized water for 30-60 seconds with spray and vibration.
5. Deoxidize in 80-90° F. nitric acid-based solution with vibration for 9-11 minutes.
6. Rinse in room temperature deionized water for 30-60 seconds with spray and vibration.
7. Rinse in 110-120° F. deionized water with over-flow for 9-11 minutes.
8. Wash the diffuser with a pressure washer.
9. Dry diffuser with dry, oil-free, filtered compressed air or nitrogen.
10. Second dry using diffuser dryer.

Bead Blasting

1. Mask all areas not to be blasted
2. A dedicated blast unit using a single grit aluminum oxide media is recommended. If the blast unit is used with other media sizes or materials it should be completely cleaned before performing any work. When cleaning the blast unit, take care to blow out any abrasive media trapped inside the media bin, feed and nozzle components.
3. In the event the bead blasting unit includes a water separator, the water separator should be drained to insure that no moisture remains, water or oil, prior to adding the blasting beads.
4. Add fresh grit, aluminum oxide (typically 99.5% purity-white) blast media to the blast unit supply container. Ensure that media is dry.
5. Abrasive blast the aluminum alloy surface to be processed, to achieve the desired surface finish.

EXAMPLE ONE

A diffuser cone exterior surface surrounding the cone-shaped exit holes was bead blasted, to achieve a 70 μ-in. Ra finish on flats and inside cone holes using the following parameters:

a. a 120 grit aluminum oxide, 99.5% purity, white
b. Nozzle angle to cone side face: 90±5 degrees
c. Nozzle distance from cone side: 12.0±1.0"
d. Nozzle traverse velocity: 3.0±1.0"/sec.
e. Nozzle step increment: 2.0±0.5"
f. Nozzle supply pressure: 70±2 psi
g. Direction of travel: X-Y (as illustrated in FIG. 8B)
h. Serpentine path of travel: The direction of each pass shall be opposite to the previous pass so as to produce a back and forth serpentine motion of the nozzle relative to the part. Use sufficient passes so as to cover entire part with a random surface appearance. Visible cosmetic variations such as lines, bands, or zones are not acceptable.
i. Each pass start & stop: Each pass shall start a sufficient distance before the part boundary and shall end a sufficient distance beyond the part boundary to ensure full and uniform blasting of the part surface.
j. The part should be blasted using horizontal and vertical lines of parallel passes. Complete all passes in one series before moving to the next.
j. All residual blast media was removed from the part using clean, dry compressed air. Determination that all diffuser holes are clear of blasting media was made using a light box inspection technique of the kind known in the industry.

Figure 8A:
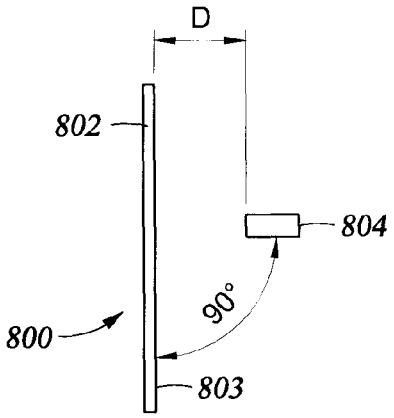
FIG. 8A shows a schematic side view of a first embodiment of a substrate position relative to a bead blasting nozzle which is used to texturize a surface of a component used in a plasma enhanced chemical vapor deposition process chamber.
Figure 8B:
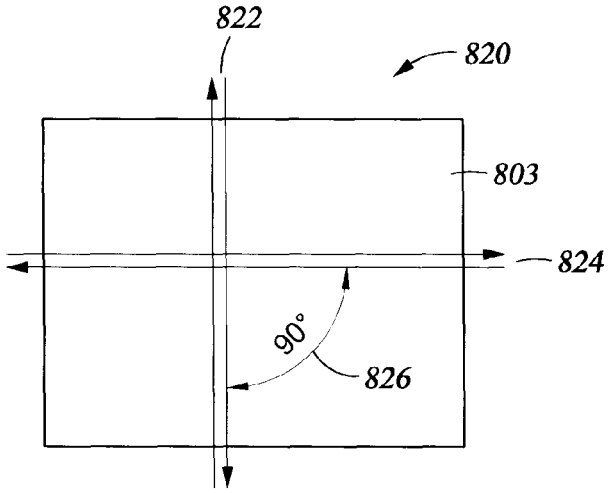
FIG. 8B shows a schematic top view of a first embodiment of a substrate which illustrates the direction of bead blasting passes relative to the surface of a component which is being texturized.

FIG. 8A illustrates one advantageous positioning 800 of a substrate 802 with respect to a bead blasting nozzle 804, where the distance "D" from substrate 802 surface 803 was typically about 12 inches. FIG. 8B illustrates the orientation 820 for each series of passes over the surface 803 of substrate 802 in the serpentine described above. A series of passes is first made in one direction 822 across surface 803, followed by rotation of the substrate by 90°, after which the process was repeated in direction 824 across surface 803. The desired number of passes in each direction across the substrate may be achieved by rotating the part as described above, or by switching the axis of travel of the nozzle.

EXAMPLE TWO

Figure 9A:
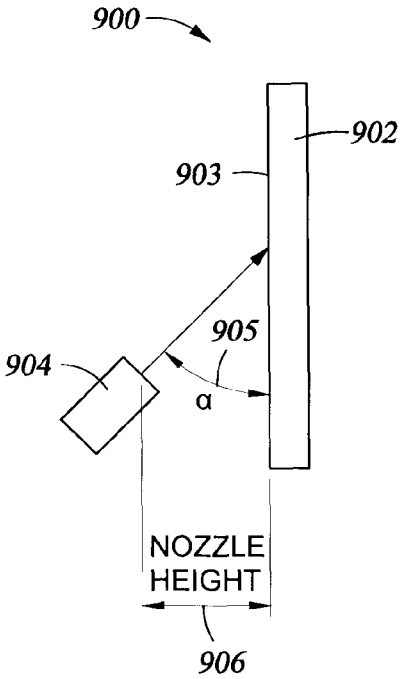
FIG. 9A shows a schematic side view of a second embodiment of a substrate position relative to a bead blasting nozzle which is used to texturize a surface of a component used in a plasma enhanced chemical vapor deposition process chamber.
Figure 9B:
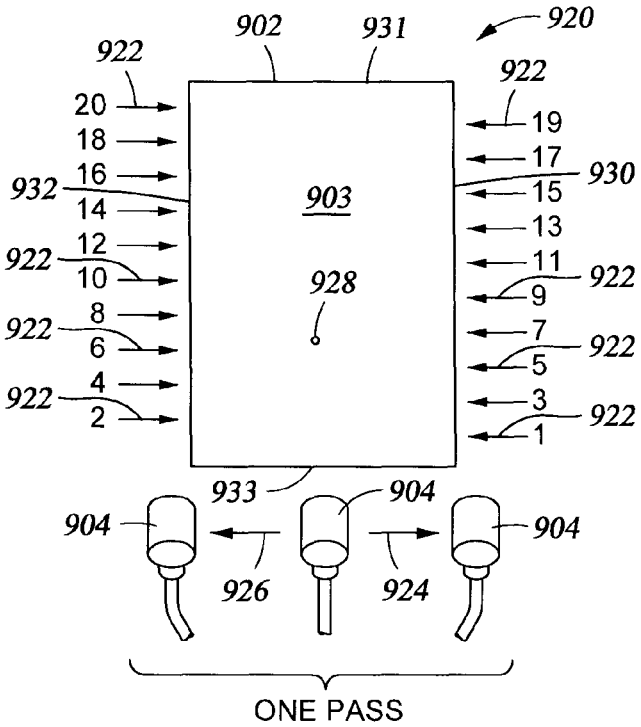
FIG. 9B shows a schematic top view of a second embodiment of a substrate which illustrates the direction of bead blasting passes relative to the surface of a component which is being texturized.

In a second aluminum alloy surface treatment process, a process chamber liner was bead blasted to obtain a 205±15 μ-inch surface. The aluminum oxide media was 35-46 grit, 99.5% purity white aluminum oxide. The abrasive bead blasting was done as a series of parallel nozzle passes, separated by a fixed horizontal step increment using automated robotic equipment of the kind known in the industry. FIGS. 9A and 9B illustrate the bead blasting configurations relative to the liner substrate 902 which was bead blasted. In the FIG. 9A configuration 900, a bead blasting nozzle 904 of the kind known in the art was positioned above the surface 903 of substrate 902 at a nozzle height 906 of about 5 inches. The nozzle angle α 905 was typically about 45° to about 47° relative to the surface 903 of substrate 902. In FIG. 9B, the configuration 920 shows the path of the nozzle 904 over the substrate 902. The horizontal step increment (distance between parallel nozzle passes 922) was typically about 1 inch. The nozzle 904 supply pressure typically was about 65 psi to about 85 psi. The direction of each bead blasting pass 924,926 was the opposite of the previous pass, so that a back and forth oscillating motion of the nozzle 904 was achieved.

The liner substrate which was bead blasted was subjected to 4 complete series of parallel passes, where the substrate 902 was rotated 90° (about the axis 928 running perpendicularly through the center of the substrate) after each series of parallel passes. Each series of parallel passes started a sufficient distance before edges 930, 931, 932, and 933 of substrate 902, and ended a sufficient distance after edges 930, 931, 932, and 933 of the substrate 902, to ensure full and uniform blasting of the part surface. While the distances between nozzle passes and the distances from a substrate edge at which a pass begins and ends will depend on the shape and size of a substrate, one skilled in the art can determine such distances for a given substrate with minimal experimentation.

After completion of the bead blasting process, the surface was treated with the Jitter Bug process previously mentioned herein, where Jitter Bug is an industry known technique for lightly sanding of an aluminum surface to remove aluminum burrs an to polish sharp edges.

While the bead blasting described in the two examples above is based on bead blasting with one size of beads, subsequent investigation indicated an improved surface could be obtained by following the above-described bead blasting procedure twice, where a different size of beads was used each time. Although a considerable difference in surface finish of the bead blasted alumina can be achieved by changing other variables in the bead blasting process, such as nozzle angle, nozzle distance, nozzle traverse velocity, nozzle step increment, nozzle supply pressure, and distance of travel, for example, it is not possible to obtain the difference in surface finish in μ-inches RA using these techniques which can be obtained by using two substantially different bead sizes and bead blasting in sequence. In the bead blasting process which made use of two sizes of beads, the beads used were alumina. The aluminum alloy surface is first bead blasted using the larger size of bead, followed by a second bead blasting using the smaller size of bead. The second blasting rounds off rough tips of aluminum which are present after the first bead blasting. The two step bead blasting technique provides an increased surface roughness, up to about 1,000 μ-inches. Excellent results have been obtained when the size of the beads used in the first bead blasting step range from about 180 μm to about 260 μm, with a common bead size being about #80 grit aluminum oxide (about 220 μm); and the size of the beads used in the second bead blasting step range from about 40 μm to about 80 μm, with a common bead size being about #220 aluminum oxide (about 60 μm). For the two bead blasting process, typically the distance of the bead blasting nozzle from the surface of the substrate ranges from about 3 inches to about 6 inches. The angle of the bead blasting nozzle relative to the surface of the substrate ranges from about 40° to about 50°. The pressure at the bead blasting nozzle typically ranges from about 70 psi to about 90 psi. The path traveled was similar to that described with respect to Example Two, above.

Using the bead blasting processes described above, one skilled in the art can obtain a surface finish on aluminum (aluminum alloy typically) ranging from about 50 μ-inches to about 1,000 μ-inches, using the bead blasting process which is most advantageous.

Post Blast Power Wash

Wash the diffuser using a pressure washer of the kind known in the industry.

Chemical Preparation for Anodization

1. Soak clean in a non-silicated mildly alkaline soap cleaner (pH<11.0) under non-etch conditions for 5 to 8 minutes, maximum. The part should turn medium dark gray in color.

Solution: Al Clene 75R (Coral Chemical Co.) 4-8 oz./gal.

Temperature: 120° F.-140° F.

2. Rinse in a neutral to mildly alkaline rinse (7.0<pH<11.0) for 30 to 60 seconds. If surface is not water break-free, repeat step 1 and 2.

3. Rinse in a neutral to mildly acidic rinse (2.5<pH<5.0) for 30 to 60 seconds.

4. Immerse in a nitric acid based deoxidizing solution for 3 minutes minimum to 5 minutes maximum with mild agitation for smut removal.

Solution: 12-18% vol. Alutone in $H_2O$.

Temperature: 65° F.-85° F.

5. Rinse in a neutral to mildly acidic rinse (2.5<pH<5.0) for 30 to 60 seconds.

6. Rinse in a neutral to mildly alkaline rinse (7.0<pH<11.0) for 30 to 60 seconds.

7. Immerse in a sodium hydroxide based alkaline etch solution 5 to 10 seconds after vigorous gassing is observed.

Solution: 3-6 oz./gal of $NaOH/H_2O$

Temperature: 120° F.-140° F.

Etch Rate: 75-125 u-in./min.

8. Rinse in a neutral to mildly alkaline rinse (7.0<pH<11.0) for 30 to 60 seconds.

9. Rinse in a neutral to mildly acidic rinse (2.5<pH<5.0) for 30 to 60 seconds.

10. Immerse in a nitric acid based deoxidizing solution for 3-5 minutes with mild agitation for smut removal.

11. Rinse in a neutral to mildly acidic rinse (2.5<pH<5.0) for 30 to 60 seconds.

12. Repeat step 7-11 as required until the part surface appears uniform in color (usually a white to gray-white tone). Ignore streaking due to smut from the deox. Do not repeat this cycle more than three times.

13. Immerse in a phosphoric/sulfuric acid based etch solution for 60 to 90 seconds after the onset of gassing, depending on the solution activity.

Solution: 5-7% vol. Sulfuric Acid, 3-5% vol. Phosphoric Acid in $H_2O$.

Temperature: 150° F.-160° F.

Etch Rate: 5-15 u-in/min.

14. Rinse in a neutral to mildly acidic rinse (2.5<pH<5.0) for 30 to 60 seconds.

15. Immerse in a 40% nitric acid solution for 3-5 minutes, maximum.

Solution: 30-50% vol. $HNO_3/H_2O$

Temperature: 55° F.-85° F.

16. Rinse in a neutral to mildly acidic rinse (2.5<pH<5.0) for 30 to 60 seconds.

17. Immerse in a fluoride-containing acid etch solution (bright dip) for 3 to 8 seconds, or until parts begin to gas vigorously.

Solution: 22-38% vol. $HNO_3$/5-15% vol. HF in deionized $H_2O$.

Temperature: 55° F.-85° F.

Etch Rate: 50-100 u-in/min.

18. Rinse in a neutral to mildly acidic rinse (2.5<pH<5.0) for 30 to 60 seconds.

19. Immerse in a 40% nitric acid solution for 1 to 3 minutes. At this point, the part surface should appear nearly bright white in color and very uniform in all directions.

20. Rinse in a neutral to mildly acidic rinse (2.5<pH<5.0) for 30 to 60 seconds.

21. Inspect all parts visually for any signs of surface non-uniformity, severe grain patterns, or suspected base material patterns. Reject any non-conforming parts. If the surface is not water break-free, or if any residual smut is observed, repeat steps 13-20.

Anodization Procedure

1. The anodizing procedure shall be a sulfuric acid based solution that meets the following specifications:

Operating Parameters:

Concentration: 15.0%±1.0% $H_2SO_4$ in deinoized $H_2O$.

Temperature: 55° F.±1° F.

Impurities: Al=5,000-10,000 ppm

Fe: <200 ppm

Cu, Zn: <100 ppm each

Cr, Ni, Na, K, Ca: <50 ppm each

Total metals (excluding Al): <250 ppm $F^-$, $NO_3^-$: <100 ppm each $Cl^-$: <50 ppm 2. Load tank, secure racks into position.

3. Set up controls. Check that current and voltage are set to zero. Turn rectifier on and note the anodize bath temperature.

4. Note: The ramp schedule outlined below is voltage specific. Anodize to 0.00035-0.00050 inch thick. The total ramp time (approximately 30±5 minutes) shall be determined by the finisher so as to approach the lower limit of the anodization thickness tolerance at the onset of dwell.

5. Allow parts to dwell 1 minute and note the voltage. If the voltage rises to 8.0 volts above, start the timer (set to the total ramp time). If the voltage does not rise above 8.0, increase the current setting by 3-5 ampere increments (allow 10 second intervals between current adjustments) until the voltage rises above 8.0, then start the timer. Two minutes after timer start, the voltage should be 9.0-9.5 volts. If not, adjust as above. Not the current. Adjust the voltage and note the temperature and the current setting per the following ramp schedule: (Note: This ramp applies to 6061 Aluminum alloy composition only.)

| | | |
|---|---|---|
| 1. | 2 min. | 8.0 V |
| 2. | 3 min. | 9.5 V |
| 3. | 5 min. | 13.5 V |
| 4. | 5 min. | 13.5 V |
| 5. | 10 min. | 21.6 V |
| 6. | 14 min. | 22.9 V |

Strip Anodization

Rinse the parts in acidic rinse for 1 to 2 minutes.

1. Strip the first anodized coating by the following method. Use minimal immersion times so as not to exceed stock loss of >0.0001" below the anodic penetration depth.

2. Rinse in alkaline rinse for 30 to 60 seconds.

3. Strip anodize in Caustic Etch using minimal immersion times (<10 seconds after the onset of gassing).

4. Rinse in alkaline rinse for 30 to 60 seconds.

5. Rinse in acidic rinse for 30-60 seconds.

6. De-smut in Deoxidizer for 5 minutes.

7. Rinse in acidic rinse for 30-60 seconds. Repeat steps 3-8 until anodize is fully stripped. When anodize is fully stripped (Diffuser is visually free of anodize and is shiny).

Post Strip Processing

1. Rinse by immersing in agitated deionized water for 3 to 5 minutes.

Temperature: 50° F.-70° F.

pH: 5.0-9.0

Impurities: Cr, Zn, Na, Ca, K: <5 ppm total,

Mg<50 ppm $Cl^-$ <50 ppm

Fe, Ni, $SO_4^{2-}$: <200 ppm each

2. Final rinse in hot deionized water for one minute, maximum.

Temperature: 110° F.-114° F.

Deionized water Resistivity: >250,000 ohm-cm

Impurities: Cr, Zn, Na, Ca: <0.5 ppm total

K, Fe, Ni: <0.5 ppm each $Cl^-$, $F^-$: <0.5 ppm each

Mg: <1.0 ppm $NO_3^-$, $SO_4^{2-}$: <2.0 ppm total

3. Wash the diffuser using a pressure washer.

4. Dry diffuser with dry, oil free, filtered compressed air or nitrogen.

5. Second dry using diffuser dryer.

EC (Enhanced Clean)=Anodization followed by Stripping

Anodization (10 um) $ Stripping

HNO3, NaOH, H3PO4/H2SO4 used prior to anodization

H2SO4 used for anodization

Caustic etching solution (strong alkaline) used for stripping anodization

–CC (Chemical Clean)=Type-II Cleaning

A chemical cleaning procedure for aluminum alloy which is generally known in the art, which makes use of a cleaning composition comprising HNO3, HF, and DI water, for a time period of 30 sec.

Figure 7:
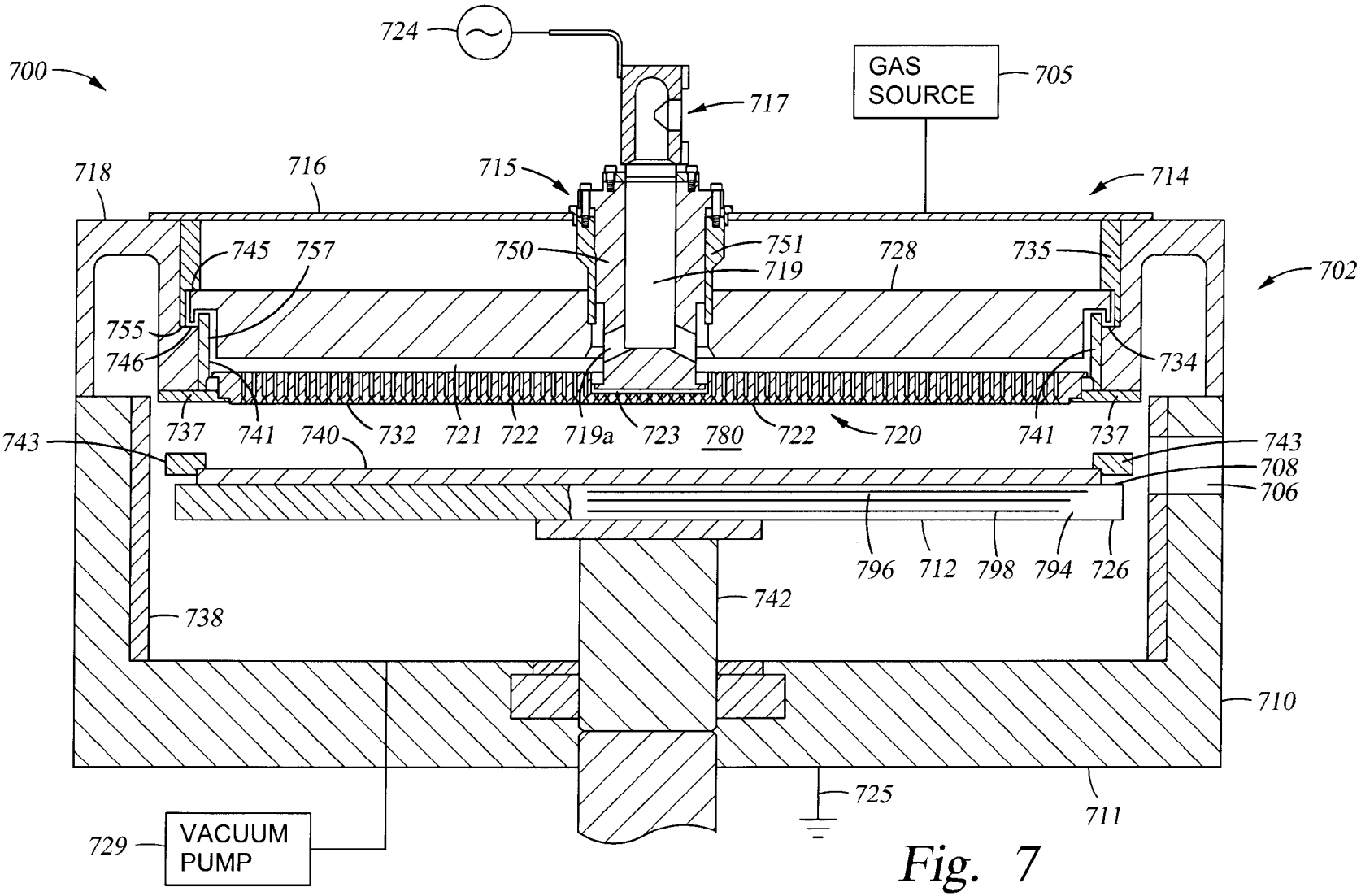
FIG. 7 shows a plasma enhanced chemical vapor deposition process chamber which includes components which are texturized using a method of the invention, to produce particular surface roughness characteristics on a surface of the components.

FIG. 7 illustrates a schematic cross sectional view of one embodiment of a plasma enhanced chemical vapor deposition system, for purposes of illustrating the elements discussed above, which may be processed in accordance with the method of the invention.

The system 700 generally includes a processing chamber body 702 having walls 710 and a bottom 711 that partially define a process volume 780. The process volume 780 is typically accessed through a port and/or a slit valve 706 to facilitate movement of a substrate 740, such as a solar cell glass substrate, stainless steel substrate, plastic substrate, semiconductor substrate, or other suitable substrate, into and out of the processing chamber body 702. The chamber 700 supports a lid assembly 718 surrounding a gas inlet manifold 714 that consists of a cover plate 716, a first plate 728 and a second plate 720. In one embodiment, the first plate 728 is a backing plate, and the second plate 720 is a gas distribution plate, for example, a diffuser. A vacuum pump 729 is disposed on the bottom of the chamber body 702 to maintain the chamber 700 at a desired pressure range. Optionally, the walls 710 of the chamber 702 may be protected by covering with a liner 738.

The diffuser 720 may have a substantially planar surface adapted to provide a plurality of orifices 722 for a process gas or gases from a gas source 705 coupled to the chamber body

702. The diffuser 720 is positioned above the substrate 740 and suspended vertically by a diffuser gravitational support 715. In one embodiment, the diffuser 720 is supported from an upper lip 755 of the lid assembly 718 by a flexible suspension 757. The flexible suspension 757 is adapted to support the diffuser 720 from its edges to allow expansion and contraction of the diffuser 720.

The spacing between the diffuser surface 732 and the substrate surface as shown in FIG. 7, is selected and adjusted to enable the deposition process to be optimized over a wide range of deposition conditions, while maintaining uniformity of film deposition. In one embodiment, the spacing is controlled to be about 100 mils or larger, such as between about 400 mils to about 1600 mils, and typically between about 400 mils and about 1200 mils during processing.

The diffuser gravitational support 715 may supply a process gas to a gas block 717 mounted on a support 715. The gas block 717 is in communication with the diffuser 720 via a longitudinal bore 719, within the support 715, and supplies a process gas to the plurality of passages 722 within the diffuser 720. In one embodiment, one or more process gases travel through the gas block 717, through the longitudinal bore 719, through angled bores 719*a*, and are deposited in a large plenum 721 created between backing plate 728 and diffuser 720, and a small plenum 723 within the diffuser 720. Subsequently, the one or more process gases travel from the large plenum 721 and the small plenum 723 through the plurality of orifices 722 within the diffuser 720 to create the processing volume 780 below the diffuser 720. In operation, the substrate 740 is raised to the processing volume 780 and the plasma generated from a plasma source 724 excites gas or gases to deposit films on the substrate 740.

A substrate support assembly 712 is generally disposed on the bottom of the chamber body 702. This support assembly 712 may be in the form of a susceptor. The support assembly 712 is grounded such that RF power, supplied by the plasma source 724, supplied to the diffuser 720 may excite gases, source compounds, and/or precursors present in the process volume 780 as described above. The RF power from the plasma source 724 is generally selected commensurate with the size of the substrate 740 to drive the chemical vapor deposition process.

The substrate support assembly/susceptor 712 has a lower side 726 and an upper side 708 adapted to support the substrate 740. A stem 742 is coupled to the lower side 726 of the support assembly 712 and connected to a lift system (not shown) for moving the support assembly 712 between an elevated processing position and a lowered substrate transfer position. The stem 742 provides a conduit for coupling electrical and thermocouple leads to the substrate support assembly 712. A shadow frame 743 is used to prevent build up of depositing film on corner, edge and side surfaces of substrate 740, and to prevent depositing film from forming on support assembly 712.

The substrate support assembly/susceptor 712 includes a conductive body 794 having an upper side 708 for supporting the substrate 740. The conductive body 794 may be made of a metal or metal alloy material. In one embodiment, the conductive body 794 is made of aluminum. However, other suitable materials can also be used. The substrate support assembly 712 is temperature controlled to maintain a predetermined temperature range during substrate processing. In one embodiment, the substrate support assembly 712 includes one or more electrodes and/or heating elements 798 utilized to control the temperature of the substrate assembly 712 during processing.

In one embodiment, the temperature of the substrate support assembly 712 that includes the heating elements 798 and cooling channels 796 embedded therein may control the substrate 740 disposed thereon so that it is processes at a desired temperature range that allows substrates with a low melting point, such as alkaline glasses, plastic and metal, to be utilized.

While the invention has been described in detail above with reference to several embodiments, various modifications within the scope and spirit of the invention will be apparent to those of working skill in this technological field. Accordingly, the scope of the invention should be measured by the appended claims.

We claim:

1. A method of reducing the amount of particulates generated from the surface of a gas diffuser which is exposed to plasma discharge within a plasma enhanced chemical vapor deposition processing chamber, wherein the gas diffuser comprises an aluminum alloy and an exterior surface, a second surface opposite the exterior surface, and a plurality of gas openings extending therebetween, each gas opening having a pin hole portion and a tapered portion extending between the exterior surface and the pin hole portion, the method comprising:

bead blasting the exterior surface and the tapered portion of the gas opening of the gas diffuser to increase the amount of surface area present on the exterior surface and the tapered portion of the gas opening;

anodizing the exterior surface of the gas diffuser to form an anodized layer on the exterior surface; and stripping the anodized layer from the exterior surface to form a non-anodized exterior surface, wherein none of the anodized layer is stripped in a plasma processing chamber and the gas diffuser which is exposed to plasma discharge has the non-anodized exterior surface.

2. A method in accordance with claim 1, wherein at least one additional step is used in combination with the bead blasting, and wherein the at least one additional step is selected from the group consisting of enhanced cleaning, chemical cleaning, light cleaning, and ultrasonic cleaning.

3. A method in accordance with claim 1, wherein the bead blasting is carried out using at least two bead blasting steps, and wherein a size of bead used in each of the bead blasting process steps decreases in each successive bead blasting step.

4. A method in accordance with claim 1, wherein the bead blasting is carried out using a combination of processing variables which produces a surface finish ranging between about 50 μ-inches Ra and about 1,000 μ-inches Ra.

5. A method in accordance with claim 4, wherein the surface finish ranges between about 100 μ-inches RA and about 500 μ-inches Ra.

6. A method in accordance with claim 5, wherein the bead blasting is carried out using a combination of processing variables which produces a surface finish ranging between about 50 μ-inches Ra and about 1,000 μ-inches Ra.

7. A method in accordance with claim 6, wherein the surface finish ranges between about 100 μ-inches RA and about 500 μ-inches Ra.

8. A method of reducing the amount of particulates generated from the surface of a process gas diffuser used during plasma enhanced chemical vapor deposition of thin films, wherein the body of the gas diffuser comprises an aluminum alloy, the method comprising:

anodizing an exterior surface of the gas diffuser to form an anodized layer on the exterior surface;

stripping the anodized layer from the exterior surface to form a non-anodized exterior surface, wherein none of the anodized layer is stripped in a plasma processing chamber; and bead blasting the non-anodized exterior surface to increase the amount of surface area present on the non-anodized exterior surface, wherein the gas diffuser which is used during plasma enhanced chemical vapor deposition of thin films has the non-anodized exterior surface.

9. A method in accordance with claim 8, wherein at least one additional step is used in combination with the bead blasting, and wherein the at least one additional step is selected from the group consisting of enhanced cleaning, chemical cleaning, light cleaning, and ultrasonic cleaning.

10. A method in accordance with claim 9, wherein the bead blasting is carried out using at least two bead blasting steps, and wherein a size of bead used in each of the bead blasting process steps decreases in each successive bead blasting step.

11. A method in accordance with claim 9, wherein the bead blasting is carried out using a combination of processing variables which produces a surface finish ranging between about 50 μ-inches Ra and about 1,000 μ-inches Ra.

12. A method in accordance with claim 11, wherein the surface finish ranges between about 100 μ-inches RA and about 500 μ-inches Ra.

13. A method in accordance with claim 10, wherein the bead blasting is carried out using a combination of processing variables which produces a surface finish ranging between about 50 μ-inches Ra and about 1,000 μ-inches Ra.

14. A method in accordance with claim 13, wherein the surface finish ranges between about 100 μ-inches RA and about 500 μ-inches Ra.

15. A method in accordance with claim 5, wherein the surface roughness is about 70 μ-inch Ra.

16. A method in accordance with claim 7, wherein the surface roughness is about 70 μ-inch Ra.

17. A method in accordance with claim 12, wherein the surface roughness is about 70 μ-inch Ra.

18. A method in accordance with claim 14, wherein the surface roughness is about 70 μ-inch Ra.

* * * * *

UNITED STATES PATENT AND TRADEMARK OFFICE

CERTIFICATE OF CORRECTION

PATENT NO. : 8,173,228 B2
APPLICATION NO. : 11/498606
DATED : May 8, 2012
INVENTOR(S) : Choi et al.

It is certified that error appears in the above-identified patent and that said Letters Patent is hereby corrected as shown below:

In the Claims:

Column 14, Claim 6, Line 54, please delete "5" and insert -- 3 -- therefor.

Signed and Sealed this
Twenty-first Day of August, 2012

David J. Kappos

David J. Kappos
*Director of the United States Patent and Trademark Office*